United States Patent [19]

Jones

[11] Patent Number: 4,550,683

[45] Date of Patent: Nov. 5, 1985

[54] SHEET CONSTRUCTION AND METHOD

[76] Inventor: Wallace R. Jones, 7621 Eagle Mills Rd., Waite Hill Village, Ohio 44094

[21] Appl. No.: 573,009

[22] Filed: Jan. 23, 1984

[51] Int. Cl.[4] ..... B05C 21/00

[52] U.S. Cl. ..... 118/505; 428/42; 428/43; 428/136; 428/137; 428/138; 428/914; 101/128.21; 101/128.4; 427/282

[58] Field of Search ..... 428/40–43, 428/136, 138, 137, 202, 203, 914; 156/240, 234; 118/505; 427/282; 101/128.21, 128.4

[56] References Cited

U.S. PATENT DOCUMENTS

| | | | |
|---|---|---|---|
| 2,574,152 | 11/1951 | Lewis et al. | 428/40 |
| 3,383,121 | 5/1968 | Singer | 428/41 X |
| 4,397,261 | 8/1983 | Jones | 118/505 |

*Primary Examiner*—Alexander S. Thomas
*Attorney, Agent, or Firm*—Fay & Sharpe

[57] ABSTRACT

An adhesive coated sheet construction adapted to be secured to a work surface for placing a predetermined design configuration thereon includes a first layer having a contact-type adhesive on a first surface thereof and a second layer which is removably affixed to the first surface of the first layer. A third layer is removably affixed to a second surface of the first layer for defining a laminated-type sheet construction. Score lines penetrating both the first and second layers define the predetermined design configuration which remains accurately positioned through retention on the third layer. Removal of selected sections of the second layer from the sheet construction enables the corresponding sections of the first layer to be adhesively secured to the work surface. Thereafter, removal of the third layer and the remaining sections of the first and second layers from association with the work surface enables a selected portion of the first layer to define the predetermined design configuration on the work surface. The sheet construction is adapted for use either as a decal or as a paint mask.

16 Claims, 5 Drawing Figures

SHEET CONSTRUCTION AND METHOD

BACKGROUND OF THE INVENTION

This invention generally pertains to laminated sheet constructions. More specifically, the present invention relates to an adhesive coated sheet construction and method which are adapted to be affixed to a work surface for defining a predetermined design configuration thereon.

The invention is particularly applicable to die cut decals and paint masks which are utilized for placing a predetermined design configuration on some work surface, and will be described with particular reference thereto. However, it will be appreciated by those skilled in the art that the invention has broader applications and may also be adapted for use in many other environments, eg., used during sandblasting or chemical etching of designs into a work surface.

Heretofore, conventional decals or paint masks did not have a three layer construction wherein score lines penetrated through two of the layers for outlining a predetermined design configuration. Moreover, conventional decals and paint masks each have had their own particular type of construction, and a single construction was not usable for both purposes. Also, conventional decal and masking sheet constructions usually were not provided with aligning means for permitting a plurality of individual sheets to be aligned correctly with respect to each other for accurately locating a composite design on a work surface.

Accordingly, it has been considered desirable to develop a new and improved sheet construction and method which would overcome the foregoing difficulties and others while providing better and more advantageous overall results.

BRIEF SUMMARY OF THE INVENTION

In accordance with the present invention, a new and improved sheet construction is provided which is comprised of three layers of material, and which can be used either as a decal or as a mask.

More particularly in accordance with the invention, the sheet construction includes a first layer having an adhesive on a first surface thereof, and a second layer which is removably affixed to the first surface of the first layer. A third layer is removably affixed to a second surface of the first layer for defining a laminated-type sheet structure. Score lines penetrate through both the first and second layers for defining a predetermined design configuration, and the design is retained intact by the third layer. Removal of sections of the second layer enables corresponding sections of the first layer to be adhesively secured to the work surface, and removal of the third layer along with the remaining sections of the first and second layers enables the first layer to define the predetermined design configuration on the work surface.

In accordance with another aspect of the invention, the first layer comprises a decal layer which may be permanently adhered to the work surface for defining a predetermined design configuration.

According to another aspect of the invention, the first layer comprises a mask layer which may be temporarily adhered to the work surface for masking it with the predetermined design configuration.

According to a further aspect of the invention, preselected portions of the first and second layers are removed from the sheet construction to expose adhesive on the third layer which facilitates temporary mounting of the sheet construction to a work surface. Preferably, the preselected portions are in a strip-like form.

In accordance with a still further aspect of the invention, additional score lines penetrate the second layer to facilitate removal thereof in sections from the first layer at predetermined areas of the sheet construction.

According to still another aspect of the invention, the periphery of the sheet construction may contain means for precisely locating the design configuration on a work surface. The locating means may also advantageously include means to facilitate accurate alignment of a plurality of the sheet constructions for forming a composite design.

In accordance with yet another aspect of the invention, the sheet construction includes apertures extending therethrough so that a plurality of the sheet constructions may be placed in a superimposed relationship on pin members.

According to another aspect of the invention, a new method for fixedly securing a predetermined design configuration to a work surface is advantageously provided.

The principal advantage of the present invention is the provision of a new sheet construction and method which can be used either to place a decal on a work surface or to mask a work surface with a predetermined design.

Another advantage of the invention is the provision of such a sheet construction and method which include locating means for accurately locating a predetermined design configuration on a work surface.

A further advantage of the invention is the provision of a sheet construction and method which can be effectively used to provide a work surface with a predetermined composite design.

Still another advantage of the invention is the provision of a new sheet construction and method which are readily adapted for use in a wide variety of design functions in a number of different environments.

Still other benefits and advantages of the invention will become apparent to those skilled in the art upon a reading and understanding of the following detailed specification.

BRIEF DESCRIPTION OF THE DRAWINGS

The invention may take physical form in certain parts and arrangements of parts, preferred embodiments of which will be described in detail in this specification and illustrated in the accompanying drawings which form a part hereof and wherein.

DETAILED DESCRIPTION OF THE PREFERRED EMBODIMENTS

Figure 1:
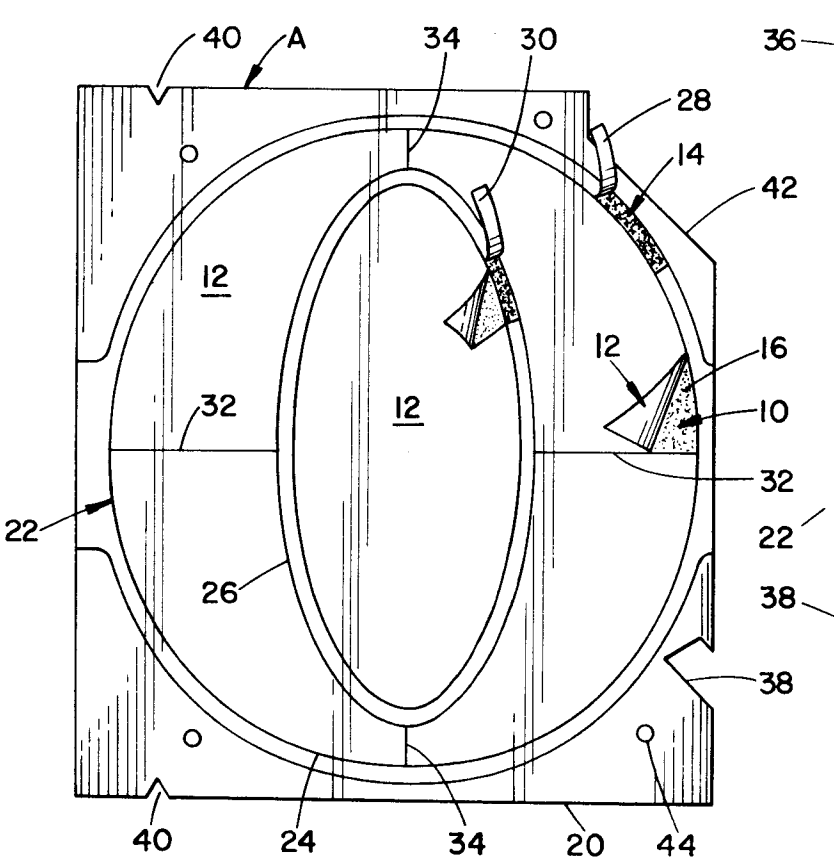
FIG. 1 is a plan view from the front face of a preferred embodiment of the subject new sheet construction with portions of the various layers pulled away for showing the structural features involved.

Referring now to the drawings, wherein the showings are for purposes of illustrating preferred embodiments of the invention only and not for purposes of limiting same, FIG. 1 shows the subject new sheet construction A. While the sheet construction is primarily designed for and will hereinafter be described as either a decal or a paint mask, it will be appreciated that the overall inventive concept involved could be adapted for use in other environments.

More particularly, sheet construction A is a laminated-type of structure comprised of a first layer 10, a second layer 12, and a third layer 14. The first layer 10 may be constructed from most conventional types of decal or masking materials, and includes a coating of a contact-type adhesive over the entirety of a first face 16 thereof. The second layer 12 functions as a liner or backing layer and may also be constructed of a conventional material. Typically, however, this material comprises a heavy paper having a release coating, and wherein this release coating is disposed in a facing relationship with the adhesive coated first face 16 of the first layer.

Figure 2:
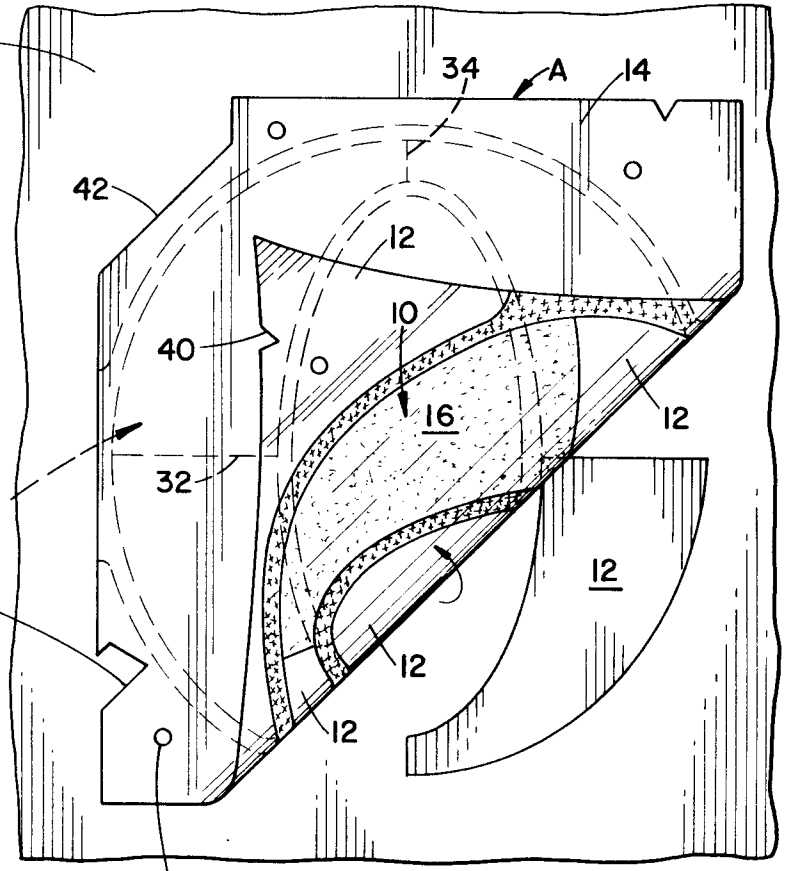
FIG. 2 shows the sheet construction of FIG. 1 partially installed on a work surface for affixing a decal thereto.

The third layer 14, which is best shown in FIG. 2, functions as a carrier layer and is adhered to the second face 18 of the first layer 10. The carrier layer 14 may be constructed of a conventional light adhesive paper which adheres moderately to the second face 18, but which can be pulled away therefrom when desired. The primary function of the carrier layer is to retain sheet construction A in an assembled condition after portions of the first and second layers 10, 12 have been removed, and during application of the sheet construction to a work surface. For reasons which will become apparent, the adhering capabilities of the adhesive on first layer first face 16 are greater than the adhesive on carrier layer 14.

The sheet construction includes a peripheral outer edge 20 extending therearound. While this peripheral edge is approximately rectangular in the view of FIG. 1, it will be readily appreciated that it may take any other form required to satisfy a particular design or application parameter.

Continuing with reference to FIG. 1, the overall sheet construction includes some predetermined design configuration as generally designated by the numeral 22 which is to be applied to a work surface. In the FIGURES, this design configuration comprises the letter "O". This letter is employed merely by way of example only, it being appreciated that the subject invention may be utilized with any type or style of design configuration whether it be letters, numerals, designs, or some combination thereof.

More particularly, the illustrated design configuration 22 is generally defined by score lines 24, 26 which extend through or penetrate both first and second layers 10, 12. The score lines, in turn, define band-like areas 28, 30 which may be removed from sheet construction A to outline the design configuration 22 and to expose the adhesive on third layer 14. Band-like areas 28, 30 may be on the order of one-half to one inch in width; however, it may be necessary and/or desirable to modify this width depending upon the particular type and size of design configuration involved. It will also be apparent that different numbers and placements of the band-like areas will be necessary for accommodating different design configurations. Also, and as used herein, the term score lines is utilized to identify areas that are severed from each other, and is not intended to infer the particular process involved to achieve severing. Thus, the score lines may be generated by die cutting, slitting, scoring and the like. The particular process employed may, in part, be determined by the nature, size, etc. of the design involved and the specific materials used for the sheet construction.

The foregoing relationship between the components facilitates retention of design configuration 22 on the sheet construction A by the third layer 14. The third layer remains intact to accommodate handling, application, and the like, while allowing selective separation of layers 10, 12, 14 in a manner to be described. Additional score lines 32, 34 are provided to penetrate through the second layer 12 only. These additional score lines enable the second or liner layer 12 to be removed in sections from first face 16 of the first layer during installation or mounting of the design. If desired or convenient, still other score lines may penetrate second layer 12 to divide it into still smaller sections.

Figure 3:
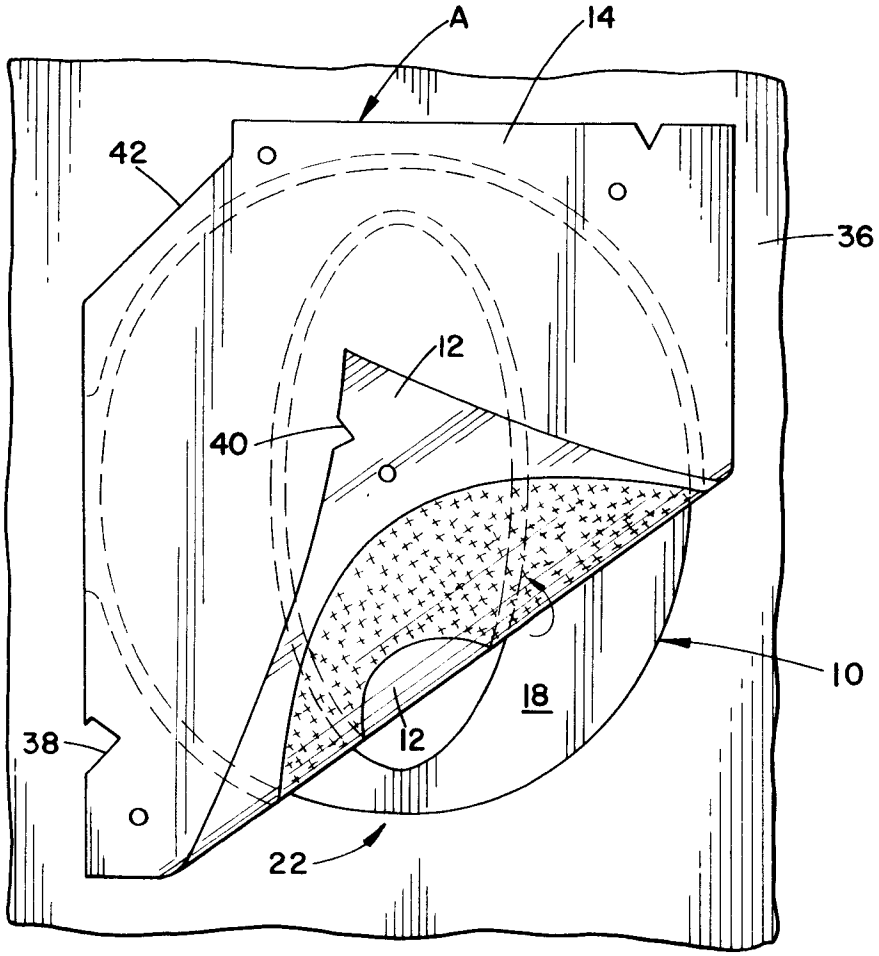
FIG. 3 shows a further installation step of the sheet construction of FIG. 1.

FIGS. 2 and 3 show use of sheet construction A for affixing a decal bearing a predetermined design on a work surface 36. In the example illustrated, the letter "O" comprises the design involved. As an initial step to preparing the sheet construction for application to the work surface, band-like areas 28, 30 are removed. Typically, such removal is performed at the manufacturing facility since it facilitates inspection of the depth and adequacy of scoring. Removal of band-like areas 28, 30 exposes identical band-like areas of adhesive on third or carrier layer 14. These adhesive bands, in turn, allow sheet construction A to be temporarily affixed in place to work surface 36, and to be adjusted as necessary to obtain proper alignment and positioning of design 22.

Once proper positioning of the sheet construction has been achieved, a portion of the sheet, as at a corner or the like (FIG. 2), is lifted away from the work surface in order that the sections of second layer 12 which cover design 22 on first layer 10 may be removed for exposing the adhesive on first face 16 of the first layer. The lifted away portion of the sheet construction is then pressed back against work surface 26 so that first face 16 of the first layer will be adhesively engaged therewith. The foregoing steps may then be repeated for the remaining sections of the design until the entire design is secured directly to the work surface.

After securing the design to the work surface as described above, the undesired and no longer needed portions of the sheet construction may be removed from the work surface. Such removal is shown in FIG. 3, and comprises peeling away of the entire sheet construction except for that portion of first layer 10 which defines the predetermined design, ie., the letter "O". The peeling process is rendered quite easy because the adhesive on first face 16 of first layer 10 which retains the design on work surface 36 is much stronger than the adhesive on carrier or third layer 14 which adheres to second face 18 of the first layer. Thus, the design will be released from the sheet construction during the peeling step.

Figure 4:
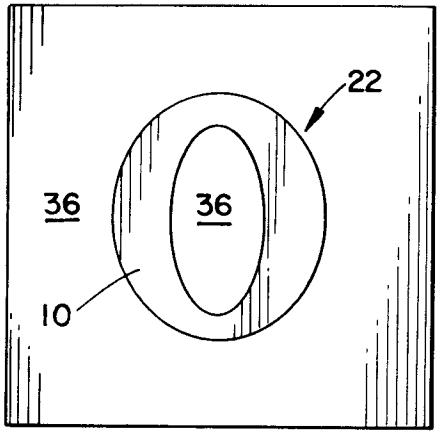
FIG. 4 is a finished view showing use of the invention for applying a decal to a work surface; and, FIG. 5 is a finished view similar to FIG. 4 showing use of the invention for applying a mask to a work surface.

Following removal of the undesired portions of the sheet construction from the work surface, only the desired design will remain fixedly secured thereto (FIG. 4). This design may then be "squeegeed" to remove any captured air bubbles or pockets and the like so that the design is smoothly and evenly adhered to the work surface.

It should be appreciated that work surface 36 may be of any desired conformation, such as a slide panel on a vehicle, a building wall, or some other structure. Since the subject new sheet construction A is made from thin flexible materials, it is readily usable with contoured work surfaces. This is particularly advantageous when the invention is to be used in connection with, for example, vehicle bodies such as on delivery trucks and the like.

Referring again to FIG. 1, a plurality of indentation, cut-out, or relieved areas 38, 40, 42 are advantageously provided at periphery 20. These areas conveniently correspond to contour or break areas on the work surface to facilitate ease of location and consistency of application for a plurality of identical decals to a plurality of identical work surfaces. Areas 38, 40, 42 shown in FIG. 1 are by way of example only, and the number and/or positioning thereof may be varied as necessary. Also, similar areas or tab-like members may advantageously be employed to align a plurality of sheet constructions A relative to each other in order that, in turn, the components of a composite design may be properly positioned and aligned relative to each other.

Moreover, one or more apertures 44 may be included on sheet construction A for allowing a plurality of the constructions to be placed or hung on suitable pin like hangers for ease of storage and access. Still further, suitable printed indicia may be included on, for example, the outer or exposed face of third layer 14 for identifying various ones of different sheet constructions, and for indicating the position thereof relative to a work surface. In like manner, indicia on the exposed face of second layer 12 may be conveniently used to identify which portions of the second or backing layer are to be removed during the installation process.

Figure 5:
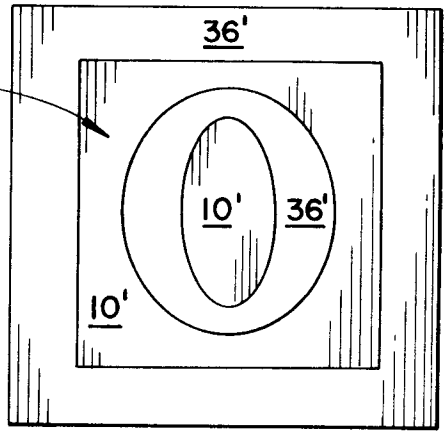

With reference now to the alternate embodiment of FIG. 5, the invention is there shown as having been used as a paint mask. For ease of illustration and appreciation of this alternative, like components are identified by like numerals with a primed (') suffix, and new components are identified by new numerals.

In this FIGURE, a mask is provided for painting a design configuration 22' on a work surface 36', and the letter "O" has again been shown as a sample design. The same general construction and steps are employed as described in detail above, except that different portions of the sheet construction remain adhered to the work surface. Here, since a mask is to be provided, all of the first layer except the portion thereof which comprises the letter "O" is, ultimately, to be fixedly secured to the work surface.

To achieve the foregoing results, and once the sheet construction has been located on work surface 36', it is peeled back away from the surface to facilitate removal of the second layer sections from a covering relationship with all areas of the inner face of first layer 10' except for the letter "O". This action exposes the adhesive deposited on the first layer inner face in order that the desired areas of the first layer may be adhesively secured to the work surface. Thereafter, when the sheet construction is removed or peeled from association with the work surface, the letter "O" portion of the first layer will be removed along with the third or carrier layer to leave a paint mask for the predetermined design, ie., the letter "O", as is shown in FIG. 5.

A plurality of masks may be installed in an appropriate relationship relative to each other for providing a mask for a composite design. Once all the masks have been installed for a particular design, the painting step may then be performed as is conventional, and the masks subsequently removed from the work surface as is also conventional.

The subject invention provides a sheet construction which is equally adapted to use for installing decals on a work surface or for masking a work surface with a predetermined design. Moreover, the invention is adapted to use in a wide variety of environments and applications. Suitable minor adjustments may be required to the precise positioning of various score lines, depending upon whether the sheet construction will be employed to install a decal or function as a mask; however, the overall concept involved is the same in either case.

The invention has been described with reference to preferred embodiments. Obviously, modifications and alterations will occur to others upon the reading and understanding of this specification. It is intended to include all such modifications and alterations insofar as they come within the scope of the appended claims or the equivalents thereof.

Having thus described the invention it is now claimed:

1. A laminated sheet construction adapted to be secured to a work surface for placing a predetermined design configuration thereon, said sheet construction comprising:

a first layer having a first contact-type adhesive disposed on a first face surface thereof;

a second layer removably affixed to said first layer at said first face surface;

a third layer removably affixed to a second face surface of said first layer opposed to said first face surface by a second adhesive of lower bonding strength than said first adhesive for defining a laminated-type sheet structure; and, first score lines coextensively penetrating both said second and first layers for defining a predetermined design configuration, preselected areas of said first and second layers being removable to expose corresponding areas of said second adhesive for allowing said sheet construction to be adhesively secured to a work surface, removal of a selected portion of said second layer incorporating said predetermined design configuration exposing said first adhesive disposed therebeneath for enabling the portion of said first layer associated with said exposed first adhesive to be adhesively secured to a work surface, and removal of said third layer and the remainder of said first and second layers enabling said first layer portion to define the predetermined design configuration on the work surface.

2. The sheet construction of claim 1 wherein said first layer comprises a decal layer which is permanently adhered to the work surface to define the predetermined design configuration.

3. The sheet construction of claim 1 wherein said first layer comprises a mask layer which is temporarily adhered to the work surface to outline the predetermined design configuration.

4. The sheet construction of claim 1 wherein said preselected areas are in a generally strip-like form.

5. The sheet construction of claim 1 further including second score lines penetrating said second layer to facilitate removal of said second layer portion in sections from said sheet construction.

6. The sheet construction of claim 1 further including means adapted for accurately locating the design configuration on an associated work surface.

7. The sheet construction of claim 6 wherein said locating means includes at least one peripheral edge of said sheet construction having a portion adapted to substantially mate with a portion of an associated work surface.

8. The sheet construction of claim 1 further including apertures extending therethrough at predetermined spaced-apart intervals adapted to receive registration pins for placing a plurality of superimposed sheet constructions in registration with one another.

9. An adhesive sheet construction adapted to be secured to a work surface for placing a predetermined design configuration thereon, said construction comprising:

a decorative layer having a first contact-type adhesive on a first face surface thereof;

a backing layer removably affixed to said decorative layer first face surface;

a carrier layer having a second adhesive on one face thereof which is of a lesser strength than said first adhesive, said carrier layer being removably affixed by said second adhesive to a second face surface of said decorative layer opposite said first face surface; and, a plurality of first score lines penetrating through both said backing and decorative layers for defining a predetermined design configuration adhesively retained on said carrier layer, removal of a portion of said backing layer exposing said first adhesive disposed therebeneath for enabling the portion of said decorative layer associated with said exposed first adhesive to be affixed to a work surface, and removal of said carrier layer with the remainder of said decorative and backing layers enabling said decorative layer portion to exhibit the predetermined design configuration in an affixed condition on the work surface.

10. The sheet construction of claim 9 further including means for accurately locating said predetermined design configuration on an associated work surface.

11. The sheet construction of claim 9 further including a plurality of spaced-apart openings therethrough adapted for receiving registration pins for placing a plurality of superimposed sheet constructions in registration with one another.

12. The sheet construction of claim 9 further including a second score line penetrating through said backing layer across said first score lines to facilitate detachment of said backing layer in sections from said decorative layer.

13. The sheet construction of claim 9 further including means adapted for temporarily affixing said sheet construction to an associated work surface.

14. The sheet construction of claim 13 wherein said affixing means comprises at least one area on said sheet construction having said backing and decorative layers removed therefrom for exposing an area of said second adhesive.

15. The sheet construction of claim 14 wherein said area comprises a narrow generally band-like zone.

16. The sheet construction of claim 14 wherein said area is defined between at least a pair of said first score lines.

* * * * *